United States Patent [19]

Wyatt

[11] 4,337,619

[45] Jul. 6, 1982

[54] HOT WATER SYSTEM

[75] Inventor: William G. Wyatt, Arlington, Tex.

[73] Assignee: Vapor Energy, Inc., Dallas, Tex.

[21] Appl. No.: 261,703

[22] Filed: May 8, 1981

[51] Int. Cl.[3] ..... F02C 7/00

[52] U.S. Cl. ..... 60/39.55; 237/9 B; 431/190

[58] Field of Search ..... 60/39.55; 431/10, 190; 122/39, 40, 41; 237/69, 9 B

[56] References Cited

U.S. PATENT DOCUMENTS

| | | | |
|---|---|---|---|
| 1,531,475 | 3/1925 | Brandt | 60/39.55 |
| 2,402,826 | 6/1946 | Lubbock | 60/39.55 |
| 2,995,895 | 8/1961 | Howes | 60/39.55 |
| 3,969,899 | 7/1976 | Nakazawa et al. | 431/190 |
| 4,009,984 | 3/1977 | Morrison | 431/190 |
| 4,211,071 | 7/1980 | Wyatt | 60/39.55 |
| 4,288,978 | 9/1981 | Wyatt | 60/39.55 |

FOREIGN PATENT DOCUMENTS

| | | | |
|---|---|---|---|
| 271706 | 5/1927 | United Kingdom | 60/39.55 |

*Primary Examiner*—Henry C. Yuen

*Attorney, Agent, or Firm*—Thomas L. Cantrell; Joseph H. Schley

[57] ABSTRACT

A versatile hot water supply system incorporating a feedback control network and vapor generator of the kind in which a fuel air mixture is combusted in a chamber through which water is flowed. The vapor generator produces a low pressure steam which is permitted to mix with a low pressure water supply at a controlled rate dependent upon the desired temperature and rate of flow of the resultant mixture. The steam formed in the vapor generator is a product of fuel combustion and evaporated feed-water accompanied by the noncondensibles remaining after combustion in the vapor generator. The vapor generator may be run on transportable fuels and therefore affords portability to the system. Control systems are coupled to temperature sensors and related feedback devices and permit the efficient and advantageous use of low pressure steam and condensibles to produce high temperature water at low or high pressures. An upstream, cold water reserve provides high volume, variable temperature capacity to the system. A down-stream holding tank is also provided with the system for providing high volume, high pressure capacity at a level not normally available in locations remotely situated from conventional utility systems.

13 Claims, 2 Drawing Figures

HOT WATER SYSTEM

BACKGROUND OF THE INVENTION

The present invention relates to hot water supply systems and, more particularly, to a versatile hot water supply system incorporating a vapor generator.

Hot water systems of conventional design generally incorporate a feedwater boiler where large amounts of cold water are stored and heated to a selected temperature which depends upon demand requirements. Such applications include industrial hot water feed lines, schools and office buildings and commercial hot water markets such as car washes and airports. Water demand generally fluctuates in such instances and much energy can be lost from heating large boilers during time of inactivity. Commercial hot water markets may include construction sites in locations often not accessible to utility lines. This presents the obvious problem of how to heat the water.

Various prior art embodiments have addressed the need for versatile hot water supply systems which meet the needs of intermediate flow demands and remote utilizations. Certain prior art systems have incorporated "in-line", electrical heating elements which directly engage the high pressure water flow along a select flow path for heating the water to a select temperature as it passes through the heater. Problems of cost, fuel energy conservation and limited demand capacity have been found to be prevalent in such systems.

Industrial applications which are remotely disposed from power utility systems present a myriad of additional problems for efficient hot-water systems. Concrete batching plants for example, are generally used in areas not having hot water, much less energy supply lines. Such applications include concrete paving of remote areas and/or the building of concrete structures. Hot water boilers and/or other prior art hot water heating elements are of extremely limited use in such markets. While combustion fuel is, or may be plentiful, means for safely and efficiently utilizing combustible fuel to meet varying hot water supply demands is severely limited by prior art designs.

One difficulty encountered in combustion fuel hot water supply units of the prior art is the high carbon monoxide content in the end product. This difficulty is particularly prevalent in prior art fuel vaporizers. Such noxious vapor content is objectionable around human occupation; a generally occurring condition where hot water is needed. High carbon monoxide production is traceable to incomplete combustion, in the main, which is in turn traceable, in part, no difficulties in maintaining stable flames in most prior art vaporizing units. Excessive quenching of flames through direct radiative and convective contact between the flame and the feedwater is often the cause. The advantages that vapor generators might have in hot water supply systems have been overlooked in light of these problems and in view of the low pressure steam produced. To be effective, low pressure steam must be automatically convertible to high pressure hot water upon demand. Prior art systems have not shown such capabilities and these hot water supply problems still exist.

The method and apparatus of the present invention address such hot water supply needs and overcomes the problems of the prior art by providing a low pressure, vapor generator in which a demand sensitive product stream substantially free of carbon monoxide and other deleterious end use gases is produced. The vapor generator of the present invention may also be used in remote areas to produce a water-steam product at a sufficiently high heat energy state to convert large cold water supplies relatively quickly into hot water at either low or high pressure.

SUMMARY OF THE INVENTION

The present invention relates to a hot water supply system incorporating a low pressure vapor generator for providing either low pressure or high pressure hot water in a demand-sensitive configuration. More particularly, one aspect of the present invention relates to a hot water supply system utilizing combustion of fuel and air and the mixture of water, steam and non-combustibles to provide resultant hot water at a select temperature. The system comprises a vapor generator of the type having a chamber for the receipt and combustion of a fuel-air mixture. Means are provided for supplying feed water to the chamber for the conversion of feed water, fuel and air to steam and non-condensibles therein. Means are also provided for conveying the steam and non-condensibles away from the vapor generator and selectively delivering supply water to be heated to the steam and non-condensibles. At least one "zone" is provided in communication with the conveying and delivering means for the mixing of the water to be heated with the steam and non-condensibles and production of resultant hot water therefrom. Means are provided for sensing the temperature of the resultant hot water and producing an output signal in response thereto. Control means are provided for detecting the output of the sensing means and controlling the supply water delivery means for regulating the flow of the supply water and, correspondingly, the temperature of the resultant hot water.

In another aspect, the invention includes a method and apparatus for producing hot water with a fuel such as natural gas or hydrogen with no deleterious by-products. The low pressure generator includes a three zone flame unit for establishing initial combustion in a reliable fashion and maintaining that combustion in the vaporizor unit. In the first zone a stoichiometric mixture is ignited and burned under shielded conditions which ensures flame stability. In the second zone excess air is introduced to the flame under shielded conditions to insure completion of combustion; and in the third zone, the flame is exposed to the feed water to vaporize it and quench the flame after combustion has been completed. Such a unit may then provide low pressure clean hot steam and non-condensibles usable around human occupancy. A temperature sensor samples the quality of the steam produced from the vapor generator. When steam of a sufficient quality is produced a control unit sensing the steam condition actuates a flow valve from a high volume cold water supply and allows the cold water to integrate with the high temperature steam. A downstream temperature sensor then relays the temperature of the steam-water mixture. This information is inputted into the control unit to govern the amount of water permitted to mix with the low pressure steam. When the desired temperature of the product mixture is achieved for that particular state of operation, the water mixture may be tapped for immediate use or directed into a water storage tank.

In accordance with another aspect of the invention, an improved vapor generator is provided in conjunction with a water storage unit having temperature and high and low water level sensing units. Data from the sensing units is inputted into the control unit to activate the cold water supply reservoir for mixture with the output of the vapor generator. The storage tank water may then be used at high or low pressure by the incorporation of an additional pumping unit. In addition, the temperature of the holding tank water may be controlled by the addition of high heat, steam-water flow from the generator. This aspect of the invention facilitates high heat storage with no high pressure considerations. Moreover, chemical additives may be incorporated in the storage tank pumping unit at various stages and/or temperatures for select applications in industry, commercial hot water markets and/or oil well pumping systems.

BRIEF DESCRIPTION OF THE DRAWINGS

For a more complete understanding of the present invention, and for further objects and advantages thereof, reference may be now had to the following description taken in conjunction with the accompanying drawing in which.

DETAILED DESCRIPTION

Figures 1, 1A:
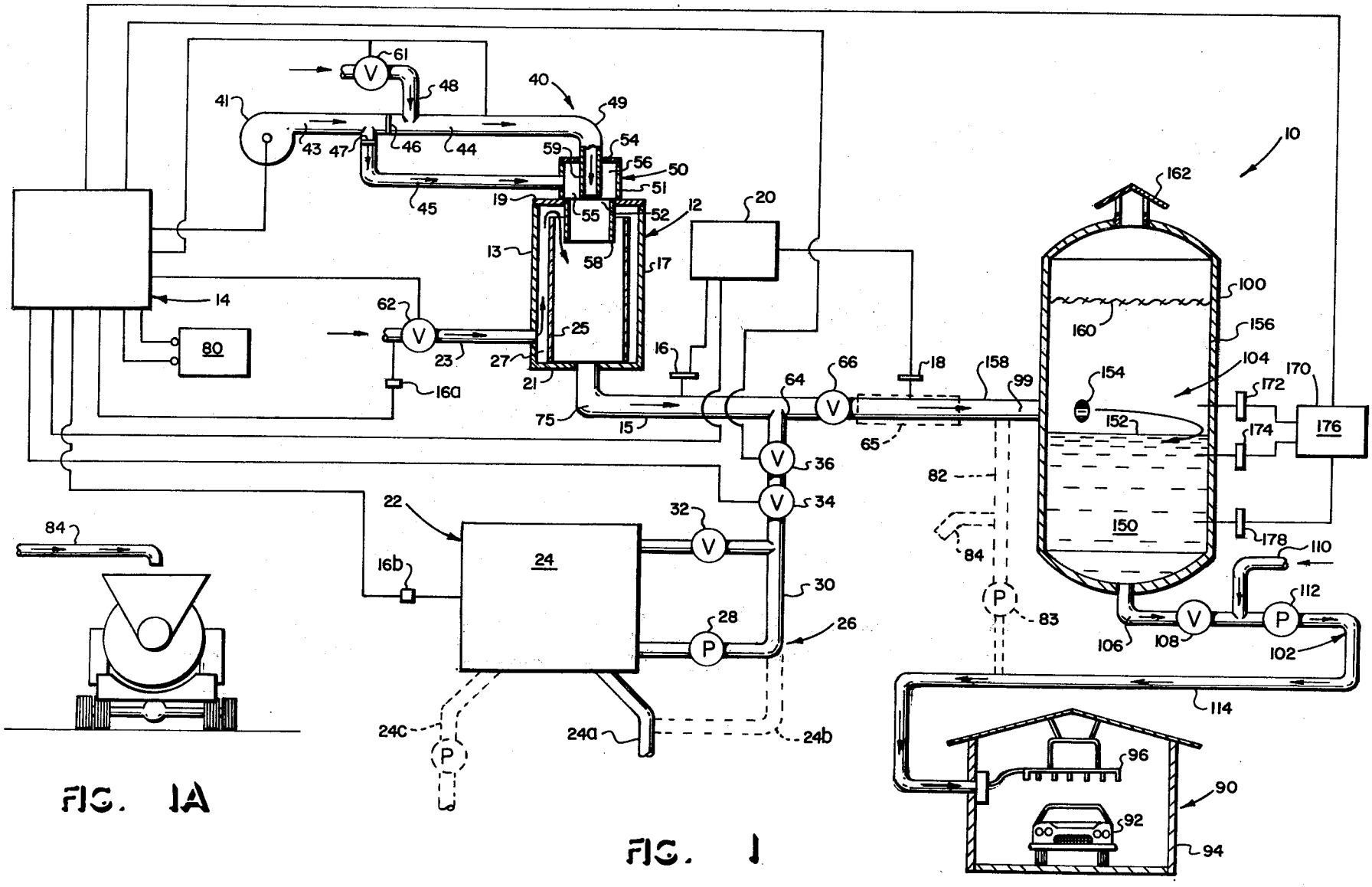
FIG. 1 is a diagrammatic elevational view, partly in section, of the method and present invention utilizing a vapor generator and water supply systems in combination with an automatic flow network.
FIG. 1A is a diagrammatic illustration of an alternative end use for the water from the system of FIG. 1.

Referring first to FIG. 1, there is shown a diagrammatic view of one embodiment of a method and apparatus for hot water production construction in accordance with the principles of the present invention. A hot water supply system 10, diagrammatically shown, includes a low pressure vapor generator 12, a programmable temperature-flow control unit 14, water supply means, associated flow conduit, and sensor and flow control means. The control unit 14 is coupled to upstream and downstream temperature sensors 16 and 18, respectively, which relay data to a temperature monitor 20. The monitor 20 is linked to the control unit 14 for temperature-sensing and responsive actuation within system 10. Control unit 14 is programmed to responsively actuate generator 12 and the flow valves governing the inflow and mixture of the generator fluid product 75 and cold supply water into conduit or flow channel 15 at the necessary rates to produce a heated fluid body 99 at a selected temperature and flow. In this manner, specific hot water demands of time, temperature, volume and pressure, can be efficiently met on an immediate use or long term storage basis. More over, the demands for the desired hot water can be met at high or low pressures, with or without chemical additives, and with apparatus lending itself to set-up and use in remote areas where utility services may not be available.

Addressing first the low pressure generator of the present invention, there is shown a vaporizer unit designated generally as 12. It may include a vapor generator of the type shown and described in my U.S. Pat. No. 4,211,071 assigned to the assignee of the present invention. The primary component thereof is the vaporizer proper or main combustion chamber 13. Chamber 13 is preferably an upright closed-ended elongated cylinder adapted to enclose the bulk of the flame generated in accordance with the invention. To the bottom of chamber 13 is connected a product exit line or conduit 15. Chamber 13 has a cylindrical outer wall 17, and closed ends 19, 21. Provision is made for the delivery of feed water to the interior of the main combustion chamber. The provisions include inlet water line 23, and internal cylindrical wall or tube 25. Tube 25 is attached to bottom end of 21 and terminates a selected relatively small distance short of top end 19. An annular space 27 is thus established between walls 17 and 25 extending over substantially the full height of chamber 13.

In operation of the generator 12 of this particular embodiment, feed water is delivered into annular space 27 through inlet line 23. The water cools the unit and is warmed as it rises through the annular space or jacket 27. The water then spills over the top edge of tube 25, and flows down its inner wall. During the first part of the downward travel, the water absorbs heat conductively from a shielded portion of the flame. During the final part of its downward flow, the feed water is in direct radiative and convective contact with part of the flame, and is vaporized thereby to form steam that becomes part of the product stream leaving chamber 13 via conduit 15.

The fuel and air delivery system of the invention is designated generally as 40. It includes an air compressor 41, having an air filter (not shown). Various types of compressors having suitable output pressures and delivery rates may be employed. The compressed air issuing from compressor 41 enters conduit 43.

The compressed air stream in conduit 43 is divided into two streams bearing a selected ratio (volumetric or mass) to each other. The division is accomplished by providing mixing conduit 44, which is an extension of air conduit 43, and branch or auxiliary air conduit 45. Conduits 44 and 45 are each connected to the precombustion chamber 50. Air flow dividing orifice plates 46 and 47 are mounted in conduits 44 and 45 adjacent the branching or division point, and the orifices in the plates are sized to bring about the desired division of the air flow. Preferably, the volume of flow through auxiliary air conduit 45 amounts to about 8 to 10 percent of the air flow through mixing conduit 44.

Immediately downstream of orifice plate 46 in mixing conduit 44 there is provided a fuel inlet 48. Flow in conduit 44 just downstream of the orifice plate 46 is quite turbulent, and it is desirable to introduce the fuel at this point to initiate thorough and intimate mixing of the fuel and air. Furthermore, it is preferred that mixing conduit 44 be fairly long in order to provide a full opportunity for thorough mixing of the air and fuel stream before it reaches the precombustion chamber. Mixing is also enhanced by the directional change in conduit 44 at bend or elbow 49. The diameter of mixing conduit 44 is selected in view of the desired flow rate so that the lineal velocity of the mixture flowing therethrough is substantially equal to or slightly greater than the flame propagation speed, so that the flame established and maintained in the precombustion chamber cannot migrate back up into conduit 44 or its bend 49. For example, with a designed fuel flow of 17 cubic feet per minute, mixed with a stoichiometric quantity of air, a nominal conduit diameter of about 2 inches is satisfactory.

The precombustion chamber of the vapor generator of the present invention is designated generally as 50. It includes a cylindrical housing 51, somewhat larger in diameter than opening 52 in the upper end 19 of chamber 13. The upper end of housing 51 is closed by plate 54. A flame enclosing skirt or shield 59 depends downwardly from plate 54, terminating short of opening 52 so that a circular slot 55 is defined between the outer edge of the skirt and the inner edge of the flange. A cylindrical annular space 56 is defined between skirt 59 and housing 51. Conduit 44 is attached to the top of the precombustion chamber to deliver a fuel-air mixture into the space within shield 59. Conduit 45 is attached to the side of the precombustion chamber to deliver auxiliary air into the annular space 56.

A pilot burner assembly, (not shown), is mounted on precombustion chamber 50 so that its mouth opens preferably into the chamber near the junction of conduit 44 and plate 54, and within skirt 59. In the vaporizer 13, a second flame enclosing shield or skirt 58 is mounted to top end 19 to depend downwardly from opening 52. The pilot flame thus formed in the pilot burner issues into the precombustion chamber to initiate combustion.

As can be seen from the foregoing, three primary input streams are involved in the generator 12: fuel gas; combustion supporting gas (preferably air from an electrically driven blower or compressor); and water. There are thus three primary points of control which are coordinated by control unit 14: fuel, air and water. Fuel metering valve 61 and feed water flow valve 62 are provided, each remotely actuatable by control unit 14. During start-up, fuel gas and sparking current are supplied to the pilot burner. During operation, a series of monitoring devices monitor various operating conditions and turn the generator 12 off, or prevent its start-up if it is already off, when a condition departs from a desired value or range of values. These monitors include thermostats, water level sensors and fuel pressure switches which provide generator operations with low level carbon monoixide production.

The particular embodiment of the present invention shown herein comprises the improved generator 12 working with a cold water supply which may simply be a water utility line **24*a* or a supply system 22 for providing the requisite water to be heated. The system 22 may be coupled to a passive body of water such as a lake (not shown) or a water utility line 24*a*. In the event supply water is taken directly from a pressurized utility line 24*a*, system 22 would be by-passed as shown in phantom by line 24*b*. The system 22 preferably comprises a storage reservoir 24, water supply line 24*a* and pumping network 26. A pump 28 is provided for high pressure circulation of water through conduit 30 out of the reservoir 24. The size of reservoir 24 may vary depending on maximum supply demands. A relief valve 32 may permit the flow of water back to the reservoir 24 in situations where pressure must be released. A remotely actuatable flow valve 34 governs the volume of flow of water from the pumping network 26 to vapor generator discharge flow line 15. A second on-off valve 36, remotely actuatable from control unit 14 may also be provided for quickly stopping or starting the flow of water between reservoir 24 and conduit 15**.

Supply water to be heated enters the channel or flow pipe 15 through cold water supply duct 64. The unheated, or cold, supply water initially contacts the generator product 75, comprising evaporated feedwater, water vapor of combustion, and non-condensibles produced by the generator 12, in open flow communication within pipe 15. A mixing chamber 65 (shown partially in phantom) is provided downstream of supply duct 64 to facilitate thorough mixing and heat transfer of these normally active constituents. The chamber 65 is shown in phantom because it could, in various configurations, comprise a valve, an orifice or simply a downstream section of flow pipe 15. The particular design of chamber 65 depends upon various design aspects of system 10 such as volume, pressure and temperature differentials between supply water and the fluid product 75.

The operation of the present invention can be seen to require specific control of the mixture of supply water and the fluid product 75 of generator 12. Cold water may be seen to come from a variety of sources such as conventional utility line **24*a*. Of course, this connection substantially restricts the system 10 to the capacity of utility line 24*a*. In remote locations where volumes of hot water of select temperatures are not beyond the capacity of available water utility lines, such configurational simplifications are feasible and within the scope of the present invention. The term capacity, however, refers both to the pressure and volume at which such utility lines can deliver water to supply duct 64**.

The present invention is particularly adapated for applications where utility lines are not available and high volume, hot water is needed. The supply system 22 provides such versatility. A storage reservoir 24 comprising a conventional storage tank or tanks, provides the capacity of high volume water feed into duct 64 during periods of demand beyond the capacity of available water systems. For example, underdeveloped and/or disaster areas often experience low water pressure and limited supply capacity. Tornados and hurricanes often cause such problems. In those instances, the storage reservoir 24 of the present invention is connected to supply pump 28, which feeds water through pipe 30, valves 34 and 36 to duct 64. The reservoir 24 can be of any size and can be supplied and/or pressurized by conventional supply line **24*a* or by an alternate pump system. Pump system 24*c* is shown in phantom to illustrate an available option for pumping water from alternate supplies such as lakes and/or temporary storage facilities (not shown). It may thus be seen that a wide range of options exists for supply water whether the system 10** is used with utilities or situated in remote, disaster or underdeveloped areas.

Once sufficient fuel and supply water is made available, as described above, the system of the present invention can produce hot water of selectable temperature and volume and do so within a wide range of time frames. The control of these production parameters is made possible by coordination of generator 12 operation, fluid temperatures and regulated flow rates from the control unit 14. As shown in FIG. 1, the volume of water from duct 64 may be controlled by valves 34 and 36, actuatable by control unit 14. The valves 32, 34, 36 and 66 may be of the conventional solenoid actuated variety. To coordinate such efforts, the control unit 14 preferably includes a conventional programmable computer capable of being programmed with the desired temperature, volume and time frame in which the final product is needed. The system 10 start up is thus the first phase of operation. The unit 14 also coordinates a second phase of continued operation and therein must sense variable input data, analyze the data relative to the production parameters and make responsive changes to the various control areas of the system 10.

In Phase I operation, the desired temperature, volume and demand time for hot water are programmed into the control unit 14 as production parameters. Ambient temperature sensors **16*a* and 16*b* communicate to the control unit 14 the initial working temperatures of the feed water and the supply water to be heated, respectively. This data forms a basis for a determination of a projected mixture ratio of heated feed water and cold supply water. The data of desired discharge volume is then determinative of the projected flow rates of the respective constituents. The control unit 14, having received the above data and determinative operational parameters, then activates one of a series of preprogrammed start-up sequences of the generator 12** to cause it to operate at the most optimal fuel-air-water ratio for the particular parameters involved.

It may thus be seen that the control unit 14 preferably includes a plurality of preprogrammed, Phase I start-up sequences for the various catagories of production parameters. These sequences are designed for maximizing operational efficiency through the Phase I start-up at particular demand levels. For example, if 1000 gallons ($V_1$) of water at 100. F. (T1) were needed over a 3 hour time frame, ($A_1$) the generator 12 could be run at a much lower combustion level ($L_1$) than the same remaining production parameters needed over a 1 hour time period conserving fuel and maximizing the efficiency of operation. The controlled combustion level ($L_2$) could likewise be maintained at the ($L_1$) level even if the temperature ($T_2$) were raised to 180. F., if the demand time frame ($A_2$) was expanded sufficiently. A combustion level ($L_3$) if a substantially higher volume ($V_3$) of heated water was needed. The algorithm for solving such operational requirements is determined by conventional mathematical, programming methods and fed into control unit 14.

Once the system 10 passes through the Phase I start-up and becomes operable at the flow rates and settings which were projected by control unit 14 to be optimal for a particular demand, the actual fluid temperatures become controlling which constitutes the second phase of operation. The vapor generator 12 needs a predefined period to reach a stabilized output. Following this stabilization period, a Phase II program in control unit 14 takes over. This program is likewise determinable by conventional mathematical programming techniques and includes receiving temperature data from sensors 16 and 18 and analyzing it.

Sensor 16 detects the temperature of the upstream fluid product of generator 12, described above. The heat content of this high temperature fluid, referred to as fluid product 75 comprising evaporated feed water and non-condensibles, is readily calculable and the monitor 20 stores and relays this information to control unit 14 for comparison with the downstream temperature condition of sensor 18. It should be noted that such segregation of function between monitor 20 and control unit 14 is presented for purposes of clarity. The heat content of the fluid product 75 engaging the heat sensor 16 is readily calculable from the volume of input feed water from channel 23 and the volume of fuel and air from valve 61 and pump 41, respectively. Once these factors are fed into the control unit 14, the heat content ($Q_1$) of the fluid product 75 detected by temperature sensor 16 is determinable. The actual heat content $Q_2$ is compared to the programmed $Q_1$ and adjustments in the three primary points of control of the generator 12 are effected by unit 14.

The heat content of the fluid 75 may also be used to vary the volume of flow, of "cold", unheated supply water from cold water duct 64. The temperature of this supply water does not have to be known although sensor **16*b* is so shown as a source of usable input data. Temperature sensor 18 alone can be used to measure downstream temperature and relay information to monitor 20 and to control unit 14. If the temperature is too low, either higher heat content from the generator 12 is needed or less "cold" water. This decision is implemented through control unit 14 which is programmed to adjust the respective flow rates toward the optimal efficiency levels discussed for Phase I operation. In this manner the system 10 is not limited in operational scope by any one factor. Both "cold" water supply volume and vapor generator heat output may be adjusted according to changes in operation conditions. Each can be automatically programmed in the present invention to balance parameter variation deficiencies in the other to produce a heated fluid body 99**, discharging at the most optimal rate for a desired temperature, volume and pressure.

The output rate of the discharging fluid body 99 produced in system 10 may be seen to be directly regulated by flow valve 66 in conjunction with the aforesaid operational parameters. An input data terminal 80 is illustratively shown in FIG. 1 and allows above described programming of control unit 14. The optimal temperature, volume, pressure and rate of flow for the resultant fluid body 99 discharged from chamber 65 is thus regulated by the control unit 14 in conjunction with the scheduled programming and actual parameters encountered. The fluid body 99 within the chamber 65 generally comprises low pressure, heated supply water, evaporated feed water and the non condensibles produced by the generator 12. In certain applications, this active fluid mixture may be directly usable. Such use depends upon the "upstream capacity" which refers to the operation level of the generator 12 and volume of supply water available. For example, with sufficient upstream capacity, the fluid body 99 from chamber 65 may be channeled through an "end" use conduit 82 directly to fluid pumping unit 83 for generating desired high pressure discharge. Conduit 82 and pump 83 comprise one use configuration shown in phantom for purposes of clarity. Also shown in phantom is another use configuration embodied in a simple discharge outlet 84 for conventional collection of the subject fluid 99.

Referring now to FIG. 1A, there is shown a concrete mixing truck of conventional design wherein heated water may be used to mix cement. It may be seen that such an application requires little water pressure and use may be intermittent in nature. For this reason, the present invention is particularly useful in heating water to mix concrete and provides an unlimited operation capacity for remote areas where concrete construction is often the initial vestage of civilization. Such a hot water supply is also useful as a means of heating and personnel use in remote areas.

High pressure hot water is a marketable commodity in itself and has a variety of commercial uses. One such market is presented in FIG. 1, in the diagrammatical form of car wash system 90. A car 92 is shown positioned in a stall 94 with a hot water discharge head 96 atop the car. The water sprayed from the head 96 is generally hot, under pressure and selectively mixed with soap or wax. Car wash operations inherently require high volumes of high pressure hot water but on an intermittent demand scale. For example, during rainy weather demand can be zero, but within an hour of clear skies, demand can exceed conventional capacity.

The present invention provides the capacity of a high volume, high pressure hot water discharge through the incorporation of a downstream storage tank 100. This particular embodiment permits the relatively low pressure, fluid discharge from chamber 65 to be collected for use in a myriad of high or low pressure applications. The storage tank 100 includes an output pumping network 102 and input settling system 104. The pumping network 102 comprises a discharge pipe 106 in combination with a regulating valve 108. Downstream of the regulating valve, an optimal, fluid intake line 110 is provided for drawing either chemical additives or water from a second water supply (not shown). A pump 112 then creates the requisite discharge pressure and channels the discharge water through conduit 114 to its end use. In this particular embodiment, the end use is shown as the car wash 90 discussed above. The election between the use of conduit 82 and tank 100 may be determined simply by demand. If maximum use demand can be supplied by the direct fluid output from chamber 65 it is possible to pressurize the fluid by pump 83 directly. The inherently active mixture of heated supply water, evaporated feed water and non condensibles produced by the generator 12 then forms an ideal mixture for car wash applications. Moreover, the combination is usually of such an active nature it necessitates the "settling tank" features of tank 100 set forth herein.

Referring particularly now to the right hand portion of FIG. 1 comprising the tank 100, hot water 150 may be maintained at a level 152 beneath an output port 154 in the side wall 156 of the tank. The port 154 is in direct flow communication with mixing chamber 65 and may serve as a discharge port for said chamber or may be spaced therefrom by a section of conduit 158. The configuration of tank 100 is perferably such that the port 154 discharges the active fluid body 99 in a tangential fashion. A tangential entry creates a vortexual swirl of the heated supply water-evaporated feed water mixture. In the vortexual swirl, the non condensibles are allowed to separate out from the mixture to leave usable hot water 150. The non condensibles and unmixed steam of the discharging fluid body 99 rise upwardly within the tank 100. A demisting screen 160 is provided to collect and condense rising steam and return it to the settled, hot water 150 therebelow. A vent 162 then permits escape of the non condensibles.

In operation, the tank 100 is coupled to a water level sensor package 170 comprising an upper and lower level detector 172 and 174, respectively, Water level signals from detectors 172 and 174 are received by tank monitor 176 which communicates with control unit 14 for coordination of the production of fluid body 99. Temperature sensor 178 may be provided in tank 100 to monitor the temperature of the stored water 150. This temperature may be received and relayed by tank monitor 176 to control unit 14. In this manner discharge fluid 99 with an increased heat content can be provided to heat the stored water 150 as necessary to maintain its usefulness over prolonged storage periods.

It is thus believed that the operation and construction of the present invention will be apparent from the foregoing description. While the method and apparatus shown and described has been characterized as being preferred it will be obvious that various changes and modifications may be made therein without departing from the spirit and scope of the invention as defined in the following claims.

I claim:

1. A method of producing hot water through combustion of fuel and air and the mixture of water, steam and non-combustibles to provide resultant hot water at a select temperature, said method comprising the steps of:

providing a vapor generator of the type having a chamber for the receipt and combustion of a fuel-air mixture;

supplying feed water to said vapor generator chamber for the conversion of said feed water, fuel and air to steam and non-condensibles therein;

conveying said steam and non-condensibles away from said vapor generator;

delivering supply water to be heated to said steam and non-condensibles in selective flow rates;

mixing of said water to be heated with said steam and non-condensibles and producing resultant hot water therefrom;

sensing the temperature of said resultant hot water and producing an output signal in response thereto; and detecting the output of said sensing means and regulating the flow of said supply water and correspondingly the temperature of said resultant hot water.

2. A hot water supply system utilizing a combustion of fuel and air and the mixture of water, steam and non-combustibles to provide resultant hot water at a select temperature, said system comprising:

a vapor generator of the type having a chamber for the receipt and combustion of a fuel-air mixture;

a means for supplying feed water to said chamber for the conversion of said feed water, fuel and air to steam and non-condensibles therein;

means for conveying said steam and non-condensibles away from said vapor generator;

means for selectively delivering supply water to be heated to said steam and non-condensibles;

at least one chamber in communication with said conveying and delivering means for the mixing of said water to be heated with said steam and non-condensibles and production of resultant hot water therefrom;

means for sensing the temperature of said resultant hot water and producing an output signal in response thereto; and control means for detecting the output of said sensing means and controlling said supply water delivery means for regulating the flow of said supply water and correspondingly the temperature of said resultant hot water.

3. The apparatus as set forth in claim 2 wherein said supply water delivery means includes supply water reservoirs, a flow passage between said reservoir and said mixing chamber, and a pump in said flow passage for supplying water to be heated from said reservoir.

4. The apparatus as set forth in claim 3 wherein said flow passage includes a remotely actuatable, flow valve for controlling the quantity of supply water supplied from said reservoir.

5. The apparatus as set forth in claim 2 wherein said control means is in communication with said remotely actuatale flow valve for said regulation of said resultant hot water temperature.

6. The apparatus as set forth in claim 2 wherein means are provided for sensing the temperature of the steam and non-condensibles produced by said vapor generator and producing an output signal in response thereto.

7. The apparatus as set forth in claim 6 wherein said control means is in communication with said steam temperature sensing means for regulating the operation of said vapor generator.

8. The apparatus as set forth in claim 2 wherein said steam conveyance means and said supply water delivery means are each sealed flow channels constructed with intersecting communication upstream of said mixing chamber for the delivery thereto of said water, steam and non-condensibles.

9. The apparatus as set forth in claim 2 wherein said apparatus includes a second mixing chamber for receiving and storing said resultant hot water.

10. The apparatus as set forth in claim 9 wherein said second mixing chamber includes a pump for emitting said resultant hot water from said chamber at select flow rates and pressures.

11. The apparatus as set forth in claim 9 wherein said second mixing chamber includes means for condensing steam and mist within said chamber.

12. The apparatus as set forth in claim 9 wherein said second mixing chamber includes at least one water level sensor to detecting the water level within said chamber and producing an output signal in reponse thereto.

13. The apparatus as set forth in claim 12 wherein said system includes control means for receiving said water level signal and actuating said vapor generator in response thereto.

* * * * *